US007687213B2

(12) United States Patent
Lobo et al.

(10) Patent No.: US 7,687,213 B2
(45) Date of Patent: Mar. 30, 2010

(54) CUSTOM COLOR TONER

(75) Inventors: Lloyd A. Lobo, Rochester, NY (US); Eric C. Stelter, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 751 days.

(21) Appl. No.: 11/511,045

(22) Filed: Aug. 28, 2006

(65) Prior Publication Data

US 2008/0050667 A1 Feb. 28, 2008

(51) Int. Cl.
*G03G 9/09* (2006.01)

(52) U.S. Cl. ..... 430/108.1; 430/108.6; 430/109.4; 430/110.1

(58) Field of Classification Search ..... 430/108.1, 430/108.6, 109.4, 110.1
See application file for complete search history.

(56) References Cited

U.S. PATENT DOCUMENTS 5,204,208 A 4/1993 Paine et al.
5,393,630 A * 2/1995 Bayley et al. ..... 430/105
5,557,393 A 9/1996 Goodman et al.
5,897,239 A 4/1999 Caruthers, Jr. et al.
6,292,643 B1 9/2001 Vo
6,413,692 B1 7/2002 Cheng
6,618,654 B1 9/2003 Zaat
6,751,430 B2 6/2004 Godlove
2005/0095521 A1 5/2005 Rimai et al.
2005/0142476 A1 * 6/2005 Kim et al. ..... 430/108.4
2006/0084000 A1 * 4/2006 Tsunemi et al. ..... 430/108.4

* cited by examiner

*Primary Examiner*—Hoa V Le
(74) *Attorney, Agent, or Firm*—Carl F. Ruoff; Andrew J. Anderson

(57) ABSTRACT

The present invention provides a custom color toner having a first particle size. Colored particles are attached to the surface of the base toner in an amount sufficient to provide a predetermined color to the base toner. The colored particles have a second particle size less than the first particle size.

17 Claims, 1 Drawing Sheet

CUSTOM COLOR TONER

FIELD OF THE INVENTION

This invention relates generally to custom color toners for electrophotographic imaging and printing apparatuses and machines, and more particularly is directed to a toner and resulting developer for providing custom colored marking particles.

BACKGROUND OF THE INVENTION

Custom colors are used in many printing and packaging applications to supplement process colors made by combinations of cyan, magenta, yellow, and black (CMYK). A typical example of a custom color is "Coca-Cola red".

Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of "custom color", which specifically refers to registered proprietary colors, such as used, for example, in corporate logos, authorized letterhead, and official seals. The yellow associated with Kodak brand products, and the brown associated with Hershey brand products are good examples of custom colors that are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area.

Further, lines and text produced by halftone process color are very sensitive to misregistration of the multiple color images such that blurring, color variances, and other image quality defects may result. As a result of the deficiencies noted above, customer selectable color production in electrostatographic printing systems is typically carried out by providing a singular premixed developing material composition made up of a mixture of multiple color toner particles blended in pre-selected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof.

The disclosures of custom color for toners in the prior art usually involve mixing toners of different colors together in one developer. This approach has the problem that toners of one color may develop at a greater rate than toners of another color, due to differences in charge, adhesion, or other characteristics, causing a color shift over time. Various means of solving this problem have been disclosed, such as mixing toners directly in the developer to control the final color, or making the toner mixtures compatible by encapsulating the pigments within the toner particle or by applying varying surface treatments to equalize the triboelectrification properties Several patents describe the apparatus that can be used for mixing differently colored toner particles into a single developer. U.S. Pat. No. 6,751,430 describes a toner purging development apparatus and method for producing custom colors. This patent provides custom colors by removing the first quantity of toner particles having a first color from the sump, and allowing the loading, of a second quantity of toner particles having a second and different color.

U.S. Pat. No. 6,618,654 describes a custom color printing system including an apparatus for developing a latent image with a custom color toner. A replaceable reservoir unit is provided for mixing and supplying the custom color toner to the donor member. An array of toner dispensers is provided for supplying various primary color toners, as required, to achieve the custom color. In such an operational environment, replaceable containers of premixed customer selectable color developing materials corresponding to each customer selectable color are provided for each print job. Replacement of the premixed customer selectable color developer materials or substitution of another premixed color between different print jobs necessitates operator intervention that typically requires manual labor and machine downtime, among other undesirable requirements. In addition, since each customer selectable color is typically manufactured at an off-site location, supplies of each customer selectable color printing ink must be separately stored for each customer selectable color print job.

U.S. Pat. No. 6,292,643 describes a traveling wave transport system that will transport individual toner colors and mixes them before they reach the photoconductor.

U.S. Pat. No. 5,897,239 describes a method to replenish the developer with the correct ratio of the individual color toner components by using calorimetric measurement of the replenished developer.

Chemical means of mitigating the differences in the triboelectric properties of the individual toner components are described in several patents. U.S. Pat. No. 6,413,692 describes preparing toner by preparing encapsulated latexes of individual colors and then carrying out an aggregation step to prepare toner particles. While this method would work, emulsion aggregation is generally restricted to vinyl-based binders and not to the polyester based toners that are preferred for high quality imaging. US Publication 2005/0095521A1 describes the use of surface treatment to equalize the tribocharging properties. While the initial charge of these particles may be the same, aging of the developer usually causes embedment of the surface treatment particles into the toner which will cause their tribocharging properties to be different. U.S. Pat. No. 5,204,208 describes method of applying a polymeric shell to individual colored toners to 'encapsulate' the pigment. While this method would succeed, it involves expensive manufacturing processes.

Most color printers have a set of 4 colorants that are used to provide the normal gamut of colors. It is desired that in order to produce a custom color outside this gamut, the toner with the basic color should be utilized and modified to provide the custom color. This invention describes a method of achieving this.

The main object of this invention is to utilize a toner with one of the primary colors and to modify it to produce a custom color.

Another object is to be able to achieve this simply and at a low cost.

Yet another object is that the modified toner of the present invention be durable under aging of the developer and maintain its triboelectric properties.

Yet another object of this invention is to be able to prepare a custom color toner with any suitable binder and with toner made by any conventional or chemical manufacturing method.

SUMMARY OF THE INVENTION

The present invention provides a custom color toner having a first particle size. Colored particles are attached to the surface of the base toner in an amount sufficient to provide a predetermined color to the base toner. The colored particles have a second particle size less than the first particle size.

Figure 1:
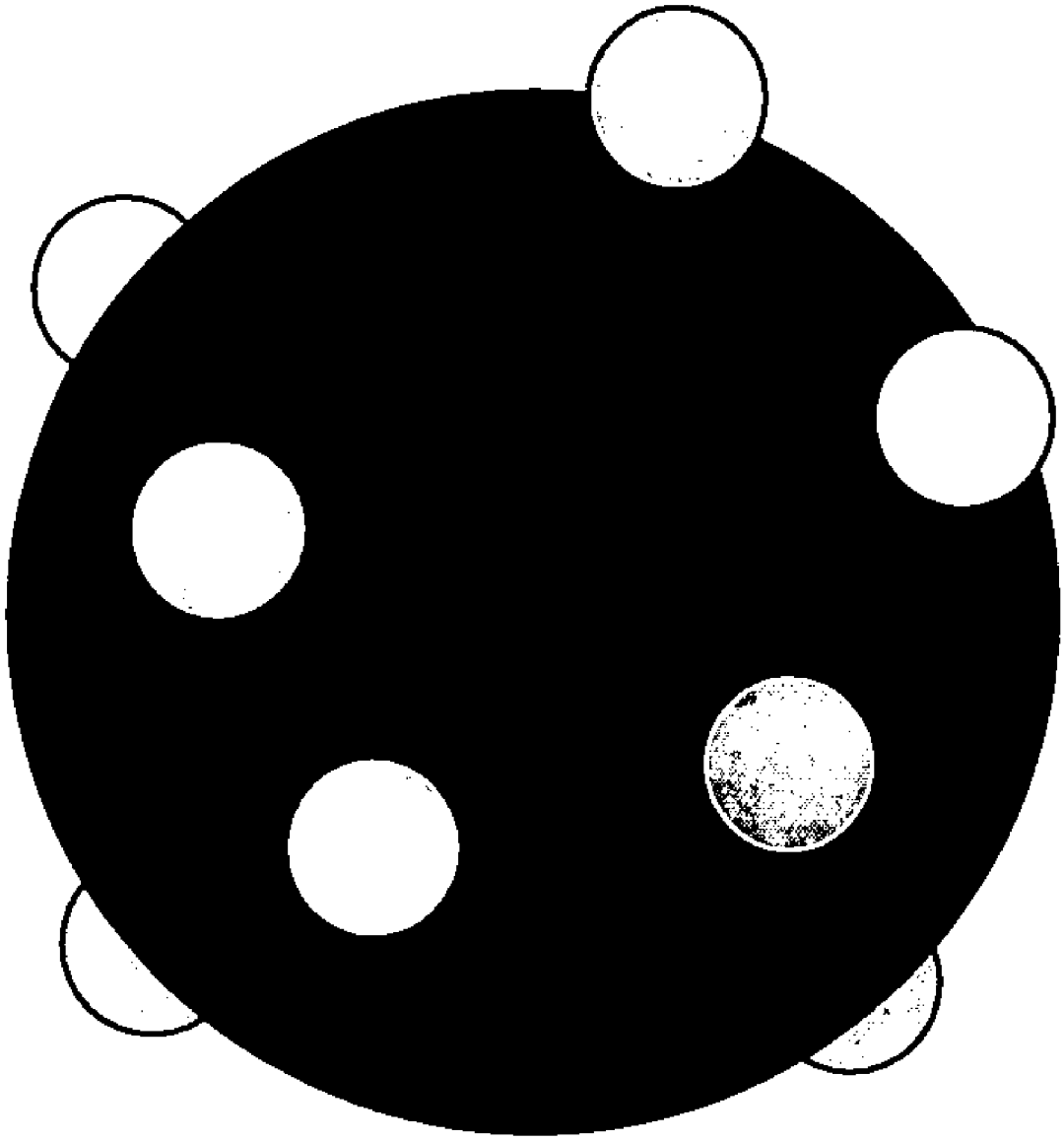
FIG. 1. Base color toner with colored surface treatment added to adjust color of final image.

For a better understanding of the present invention together with other advantages and capabilities thereof, reference is made to the following description and appended claims in connection with the preceding drawings.

DETAILED DESCRIPTION OF THE INVENTION

In the present invention, the problem of color shift is prevented by making custom color using a single color base toner and small pigmented particles that are adhered to the surface of the base color toner. The small pigment particles have large surface forces holding them to the base toner relative to electrostatic forces from tribocharge. In addition the small pigment particles have at least 10% of their weight in a polymer binder associated with them. During the surface treatment step, high-energy collisions occur between the large toner particles and the small pigmented particles. The polymers in both the particles have high affinity for each other and may partially fuse together. Thus, the large relative magnitude of the surface forces and the presence of a polymer with the pigment particles prevent the pigment particles from developing unless they are bound to the polymer of the base toner particles. This prevents the relative concentrations of colored particles in the developer from changing over time, and prevents unwanted color shifts.

The small particles of pigment can be made in several ways. While one option is to dry grind the toner particles, it is not energy efficient to prepare small size particles in this manner.

The present invention relates to toners and developers containing the toners of the present invention. The base toner contains at least one resin or polymeric binder. Useful binder polymers (or toner resins) include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders.

Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols. Other useful resins include polyester resins, such as by the co-polycondensation polymerization of a carboxylic acid component comprising a carboxylic acid having two or more valencies, an acid anhydride thereof or a lower alkyl ester thereof (e.g., fumaric acid, maleic acid, maleic anhydride, phthalic acid, terephthalic acid, trimellitic acid, or pyromellitic acid), using as a diol component a bisphenol derivative or a substituted compound thereof Specific examples are described in U.S. Pat. Nos. 5,120,631; 4,430,408; and 5,714,295, all incorporated herein by reference, and include propoxylated bisphenol—A fumarate, such as Finetone.RTM. 382 ES from Reichold Chemicals, formerly Atlac.RTM. 382 ES from ICI Americas Inc.

A useful binder can also be formed from a copolymer of a vinyl aromatic monomer; a second monomer selected from either conjugated dyne monomers or acrylate monomers such as alkyl acrylate and alkyl methacrylate.

Typically, the amount of toner resin present in the toner formulation is from about 85 to about 95% by weight of the toner formulation.

The base toner particles can include one or more toner resins which can be optionally colored by one or more colorants to get a close match with the custom color by compounding the resin(s) with at least one colorant and any other ingredients. Although coloring is optional, normally a colorant is included to provide a color that is close to the custom color and can be any of the materials mentioned in Colour Index, Volumes I and II, Second Edition, incorporated herein by reference. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

The term "charge-control" refers to a propensity of a toner addendum to modify the triboelectric charging properties of the resulting toner. A very wide variety of charge control agents for positive and negative charging toners are available. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl) azo]-3-hydroxy-N-phenyl-2-naphthalenecar-boxamidato (2-)], ammonium, sodium, and hydrogen (Organoiron available from Hodogaya Chemical Company Ltd.).

Optionally a wax can be part of the base toner resin. Waxes can function as release agents in the fusing system. They can also function as aids to increase the abrasion resistance of the image. Depending on the functionality of the wax the melting temperature of the wax can vary from 40°° C. to 130C. Any conventional wax can be used with toner of the present invention. Useful waxes include low molecular weight polypropylene, natural waxes, low molecular weight synthetic polymer waxes, commonly accepted release agents, such as stearic acid and salts thereof, and others.

The wax is preferably present in an amount of from about 0.1 to about 10 wt percent. Examples of suitable waxes include, but are not limited to, polyolefin waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as Polywax 2000, Polywax 3000, and/or Unicid 700; and waxes from Sanyo Chemical Industries such as Viscol 550P and/or Viscol 660P. Other examples of suitable waxes include waxes such as Licowax PE130 from Clarient Corporation.

In a typical manufacturing process, the polymeric binder, along with the optional colorant, wax and charge control agent is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer. The well mixed extradite is then pulverized in an equipment such as a jet mill to produce powder with a relatively broad distribution. Classification can be carried out on these powders to narrow down the distribution.

A second method of making toners is by dissolving or dispersing the toner components in a solvent and particles are prepared via the limited coalescence process. The polymer may be made using a limited coalescence reaction such as the suspension polymerization procedure disclosed in U.S. Pat. No. 4,912,009 to Amercing et al., which is incorporated in its entirety by reference herein.

Other chemical methods of preparing toner particles are emulsion aggregation and suspension polymerization.

Toner particles prepared by any of the above described means or other means can be used in the current invention. The particle size of toners applicable to the current invention can preferably range from 2 μm to 30 μm. The shape of the toners can vary from spherical to the naturally irregular shapes obtained from milling.

The small particle colored dispersion is typically composed of at least one colored material and a polymeric binder. The colored component can be selected from the set described above. These include pigments and dyes. The polymeric binder can be chosen from the set of polymeric materials described above for the toner binders. In addition, because of the low amount of this binder that would be present in the final toner, other binder materials can be selected. These would include thermoses polymers such as epoxy resins and the like. The restriction on molecular weight of the small particle polymer binder is less than that of the toner binder that is imposed by fusing needs. For example substantially crosslinked or crosslink able polymers can be used. The amount of colored material in the small particles can vary depending on the pictorial strength of the colored component. While the small particle dispersion can be composed of entirely the colored component, it is desirable to have a strong cohesive force between the small particle and the toner surface and for this some amount of polymeric binder is desirable. For improving the cohesiveness of the small particle, at least 10% by weight of the composition of the small particle should be the polymeric binder. The ability to tune the hue angle of the small particle may necessitate the use of a combination of colored components. Similarly the functionality of the binder may require a combination of polymers to improve the cohesive strength of the small particles. Thus, more than one colored component and more than one polymeric binder can comprise the small particle. The particle size of the small particle dispersion should be smaller than the toner. Thus, it should preferably be smaller than 2 μm. There is no lower limit on the size of these particles.

The small particles can be made in several ways. The pigment or dye can be melt compounded with a polymer as described above and then pulverized to small particles less than 2 μm. However, it is difficult and expensive to create small particles particularly for pigment rich extradites, because of the high strength of these filled materials. A preferred method of preparing these materials is to dissolve the binder and the colored material in a substantially water immiscible solvent. Solvents that are useful for the preparation are chloromethane, dichloromethane, ethyl acetate, propel acetate, vinyl chloride, methyl ethyl ketene (MEK), dichloromethane, carbon tetrachloride, ethylene chloride, dichloromethane, toluene, xylem, cyclohexanone, 2-nitropropane, and the like. In some instances it may be more desirable to use a mixture of two or more of the above solvents. The colored material is also added to the solvent. In case of pigments, the colored material is suspended in the solvent. Dyes are dissolved in the solvent. For pigments it may be desirable to reduce their particle size, to increase their covering power. This can be accomplished by milling the pigment using methods known in the art, such as media milling, attritor etc.

The solution of the colorant and binder is then homogenized with an aqueous solution containing one or more surfactants or dispersants. Typical low molecular weight surfactants can be anionic, cationic or nonionic. Examples include sodium dodecyl sulfate, sodium dodecyl benzene sulfonate, pluronic class, tetronic class etc. Other stabilizers can also be selected, such as polymers, proteins etc. The solvent phase is dispersed in the aqueous phase in a ratio from 1% to 70% and then homogenized to get the desired particle size. The dispersion of the solvent drops containing the binder and colorant and the dispersant in the aqueous medium is then vigorously mixed by any suitable device including high speed agitation, ultrasonic devices, homogenizers, and the like in order to reduce the particle size desired. The solvent is then removed by any one of several methods, including dialysis, vacuum distillation, air or N2 purge etc. The particulate dispersion as an aqueous slurry is ready to be used for surface treating the toner particles. If desired the stabilizing surfactant used to make the dispersion can be removed by dialysis or ultrafiltration and further concentrated.

The colored surface treatment or pigmented particles are smaller than the toner particles, typically less than 4 microns, and preferably less than 2 microns The aqueous dispersion can be added directly to the toner for the surface treatment. In one embodiment the aqueous dispersion is added to the toner powder and blended by tumbling, followed by drying. Subsequently this mixture is then subjected to strong agitation in a powder blender such as a Waring blender or Henschel. The strong collisions result in the formation of a surface coating of the small particles on the surface of the toner. In a second embodiment, the surface treatment is carried out in a fluidics coating device as described in GB2357050. The toner particles and the aqueous dispersion of small particles are introduced into the device chamber. In order to aid drying, the compressed air can be partially heated prior to entering the chamber. In addition to the above mentioned devices, other mixing devices that impart high collision energy can be used. The agitation can be done in multiple stages either in the partially wet state or in the fully dried state.

The amount of tint that can be provided to the core toner is not restricted. The core toner can itself be colored or without color. In addition to providing a different tint to the core toner, the small particles can be also used to increase the chroma of the core toner by using the same colorant in the core toner and the small particle. The change in the color properties of the toner can be represented by density, L*, a*, b* and c* values. The hue angle is one measure of the change in tint of the toner. The hue angle is obtained by plotting with a* on the x-axis and b* on the y-axis. The angle measured anticlockwise from the x-axis (a* axis) is defined as the hue angle.

The amount of surface treatment material added to the core toner is not restricted. While the surface treatment material can exceed the weight of the core toner, it is practically difficult to coat a large number of particles on a specific area. Thus, the preferred amount of surface treatment material is less than 20% of the core toner and more preferable 10% of the core toner.

In addition to the surface treatment provided by the small particles, the toner formulation can optionally contain at least one surface treatment agent also known as a spacing agent. The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof. While the small particle surface treatment provides some degree of improved powder flow to the toner, the conventional spacing agent significantly improves the flow, especially when the core toner size is less than 10 μm. Additionally, some of the spacing agents modulate the tribocharging properties of the toner. The amount of the agent on the toner particles is an amount sufficient to permit the toner particles to be stripped from the carrier particles in a two component system by the electrostatic forces associated with the charged image or by mechanical forces. Preferred amounts of the spacing agent are from about 0.05 to about 5 weight percent, and more preferably from about 0.1 to about 3 weight percent, and most preferably from about 0.2 to 0.6 weight percent, based on the weight of the toner.

The spacing agent can be applied onto the surfaces by similar means described above for the small particles. The spacing agent can be applied in a separate step or the same step of surface treatment of the small particles.

The present invention further relates to a developer containing the above-described toner. Thus, the present invention relates to developer systems, which are two component developer systems or monocomponent developer systems.

In a two-component developer system, the developer system contains the above-described toner along with carrier particles. These carrier particles can be hard or soft carrier particles. With respect to a monocomponent developer system, at least one resin or polymeric binder is present and charging particles are also present.

When the toner formulation of the present invention is used in a two-component toner, the carrier particles used in association with the toner formulation can be conventional carrier particles. Thus, the carrier particles can be hard or soft magnetic carrier particles. With a two-component developer, the toner concentration of the present invention is preferably present in an amount of from about 1 wt % to about 25 wt %, and more preferably from about 3 wt % to about 12 wt % based on the weight of the developer.

In more detail, the set up of the development system is preferably a digital printer, such as a Nexpress Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6Fe_2O_3$, wherein M is barium, strontium, or lead as disclosed in U.S. Pat. No. 716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and poly(vinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

When the toner formulation of the present invention is used in a single component toner system, the toner formulation has present charging particles as well, such as negatively charging particles. The amount of the charging particles for the single component optional system are conventional amounts. When a single component system is used, preferably the charging particles are at least one type of magnetic additive or material, such as soft iron oxide which is dispersed in the toner. Examples of useful charging particles include mixed oxides of iron, iron silicon alloys, iron aluminum, iron aluminum silicon, nickel iron molybdenum, chromium iron, iron nickel copper, iron cobalt, oxides of iron and magnetite. Other suitable magnetic materials that can be present in the toner include, but are not limited to, magnetic material containing acicular magnetites, cubical magnetites, and polyhedral magnetites. A useful soft iron oxide is TMB 1120 from Magnox Inc.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The base toner particle is of a size that can easily be developed by, for example, a two-component development system using magnetic carrier. Toner typically 6 microns or larger in diameter can be used.

This invention is particularly applicable to systems in which the image is overcoated. The pigment particles will be held onto the image by the overcoat and cannot be rubbed off, for example.

An advantage of this approach compared to compounding is that custom colors can be made in a blender without expensive compounding or extruding equipment. This allows colors to be made at customer sites or at localized distribution sites if necessary. Smaller batches can also be made on demand.

A set of base colored toner particles will require more than 3 or 4 "primary" colors. Colored or colorless base toner particles can be used. The pigment particles can be made with the same binder as the toner particles, or may also include charge agents. Pigment particles of primary colors CMYK and white are preferred. The pigment particles can be made by limited coalescence or other chemical techniques.

FIG. 1 shows a toner particle of the present invention. A base toner of blue (shown in black) has attached to its surface yellow particles (shown as unshaded) to shift the base blue color.

The following examples illustrate the practice of this invention. They are not intended to be exhaustive of all possible variations of the invention. Parts and percentages are by weight unless otherwise indicated.

EXAMPLES

Example 1

Three pigments: copper phthalocyanine, pigment yellow 180 and Pigment Red 122 were used to make solid particle dispersions. With each pigment, a composition containing 90% ethyl acetate, 9% pigment and 1% of Piccotoner 1221 (Styrene-butyl acrylate polymer made by Hercules). The composition was put in a jar along with 1.8 mm zirconia beads. The jars were shaken on a SWECO mill for 24 hrs. The milling media was separated from the pigment dispersion.

An organic solution/dispersion was made by dissolving a bisphenol A type polyester in ethyl acetate and then adding the pigment dispersion. The composition of the organic phase was 80% ethyl acetate, 5% of the pigment and 15% of polymer. An aqueous phase was made by dissolving Sodium Dodecyl Benzene sulfonate in water at a level of 2 wt %. The oil phase was coarsely dispersed in the aqueous phase and then passed through a high pressure homogenizer. The emulsified dispersion was stripped off ethyl acetate in a rotoevaporator. The surfactant in the dispersion can be optionally removed by washing the dispersion in an ultrafiltration cell, with a 140K Dalton cutoff membrane.

The final dispersions had the following composition

| Dispersion | Pigment | Pig./polymer | % solids |
|---|---|---|---|
| D1 | Copper phthalocyanine | 1/3 | 5.4 |
| D2 | PR122 | 1/3 | 7.6 |
| D3 | PY 180 | 1/3 | 3.3 |

Surface Treatment of Toners

Toner particles with an approximate size of 8 micron were prepared by pulverizing Tuftone NE303. These toners were without pigment. 10 gm samples of toner were surface treated with the pigmented small particle dispersions. Enough quantity of dispersion was added to the toner sample such that the final pigment concentration was at the desired levels (from 0.2 to 0.5 pph of pigment in the toner). The sample was subject to agitation in a Waring Blender for 30s. The samples were left to dry overnight and then re-treated in the Waring blender.

Imaging of the Treated Toners.

The surface treated samples were biased developed onto a strip of paper. Half of the toned patch was vacuumed off and weighed to estimate the weight letdown of the toner. The paper strip was then passed through a fuser roller and the patch was fused at 350° F. The fused patches were then read on a densitometer for the different colors with Status A filters. The table below shows the reflection density obtained for the cyan, magenta and yellow filters, for patches having a letdown of approximately 1.0 mg/cm$^2$.

| | | channel | | |
|---|---|---|---|---|
| Sample A | ST dips | cyan | magenta | yell |
| | none | 0.07 | 0.10 | 0.09 |
| B | D1 (cyan) | 0.5 | 0.3 | 0.25 |
| C | D2 (magi) | 0.13 | 0.29 | 0.24 |
| D | D3 (yell) | 0.13 | 0.22 | 0.27 |

The clear toner treated with the cyan, magenta and yellow small particle dispersions shows the increase in the absorbance in the corresponding color channel. The example shows that small particle dispersions containing colorant (pigment or dyes) can be used to tint the toners and change the hue.

Example 2

Hue Manipulation of Colored Toners

The small particle dispersions D1, D2 and D3 described above were used to manipulate the hue of colored toners (toners containing pigments). The colored toners had the following composition Toner T1 (Cyan)

96.7 parts per hundred bisphenol A type polyester binder
3.3 parts per hundred of pigment blue 15:3 pigment Toner T2 (Magenta)

95.8 parts per hundred bisphenol A type polyester binder
4.2 parts per hundred Pigment red 57:1 yanine pigment Toner T3 (Yellow)

96.46 parts per hundred bisphenol A type polyester binder
3.54 parts per hundred of Pigment yellow 185

Surface Treatment of Toners with Dispersions

Each toner was surface treated with each of the three dispersions D1, D2 and D3. Each toner/dispersion combination had three levels of surface treatment—1, 2 and 4 parts per hundred of toner (based on the solids in the dispersion). The corresponding pigment levels in the surface treatment is 0.25, 0.5 and 2 parts (25% pigment in the total solids). The methodology of surface treatment was similar to the one described in example 1.

Developer Preparation and Charge Measurements

Each of the surface treated and core toners were combined with a carrier such that the toner concentration in the developer was between 8 and 10%. The carrier was a hard magnetic strontium ferrite (Powdertech, Kashiwa, Japan) with a mean volume diameter of ~22 μm. The carrier particles were coated with either 1.25 parts per hundred of poly methyl methacrylate or 0.3 parts per hundred of the same. The carrier was magnetized prior to forming the developer. The hard magnetic ferrite carriers are described in U.S. Pat. No. 4,546,060 to Jadwin and Miskinis.

Toner charge to mass (Q/m) is measured in microcoulomb per gram (mu.C/g) within a "MECCA" device described hereinafter, after being subjected to the "exercise periods", also as described hereinafter.

The first exercise period consists of vigorously shaking the developer to cause triboelectric charging by placing a 4-7 g portion of the developer into a 4 dram glass screw cap vial, capping the vial and shaking the vial on a "wrist-action" robot shaker operated at about 2 Hertz (Hz) and an overall amplitude of about 11 centimeters (cm) for 2 minutes. The developer is then subjected to an additional, exercise period of 2 minutes on top of a rotating-core magnetic brush. The vial as taken from the robot shaker is constrained to the brush while the magnetic core is rotated at 2000 rpm to approximate actual use of the developer in an electrographic process. Thus, the developer is exercised as if it were directly on a magnetic brush, but without any loss of developer, because it is contained within the vial. Toner charge level is measured after this.

The toner Q/m ratio is measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram (μm C/g) is calculated by dividing the accumulated charge by the mass of the deposited toner taken from the upper plate.

| Core Toner | Surface Treatment Disp | Surface Treatment Level | Carrier Coating | Q/M |
|---|---|---|---|---|
| T1 | none | | 0.3 pph | −90.99 |
| T1 | D1 | 1 | 0.3 pph | −51.50 |
| T1 | D1 | 2 | 0.3 pph | −48.28 |
| T1 | D1 | 4 | 0.3 pph | −32.63 |
| T1 | D2 | 1 | 0.3 pph | −38.90 |
| T1 | D2 | 2 | 0.3 pph | −32.38 |
| T1 | D2 | 4 | 0.3 pph | −26.30 |
| T1 | D3 | 1 | 0.3 pph | −76.02 |
| T1 | D3 | 2 | 0.3 pph | −75.05 |
| T1 | D3 | 4 | 0.3 pph | −72.29 |
| T2 | none | | 0.3 pph | −74.27 |
| T2 | D1 | 1 | 0.3 pph | −60.49 |
| T2 | D1 | 2 | 0.3 pph | −54.39 |
| T2 | D1 | 4 | 0.3 pph | −45.31 |
| T2 | D2 | 1 | 1.25 pph | −41.96 |
| T2 | D2 | 2 | 1.25 pph | −42.73 |
| T2 | D2 | 4 | 1.25 pph | −39.19 |
| T2 | D3 | 1 | 1.25 pph | −49.59 |
| T2 | D3 | 2 | 1.25 pph | −55.00 |
| T2 | D3 | 4 | 1.25 pph | −51.90 |
| T3 | none | | 0.3 pph | −20.40 |
| T3 | D1 | 1 | 0.3 pph | −11.60 |
| T3 | D1 | 2 | 0.3 pph | −10.98 |
| T3 | D1 | 4 | 0.3 pph | −9.22 |
| T3 | D2 | 1 | 1.25 pph | −13.43 |
| T3 | D2 | 2 | 1.25 pph | −12.30 |
| T3 | D2 | 4 | 1.25 pph | −10.59 |

-continued

| Core Toner | Surface Treatment Disp | Surface Treatment Level | Carrier Coating | Q/M |
|---|---|---|---|---|
| T3 | D3 | 1 | 0.3 pph | −22.04 |
| T3 | D3 | 2 | 0.3 pph | −25.92 |
| T3 | D3 | 4 | 0.3 pph | −21.76 |

For a negative charging system, we see that the toner charge after surface treatment, while changed from the core toner charge remains negative and thus can be used without too much manipulation. Methods to change the level of charge include using hydrophobic silica as part of the surface treatment step as well as changing the coating on the carrier particles.

Imaging and Hue Measurement:

The core toners and surface treated toners were used to create patches on Lustro Laser paper. The patches were created by a tone charge device where the developer was deposited on a magnetic brush. A strip of paper attached to a metal plate was passed over the brush. During this process the bias on the plate was changed, such that the toner developed with a varying density. The paper was then passed through a fusing roller at 127° C. where the toner was fused.

The density of different points of the patch was read along with the spectral information using a reflection densitometer, a Gretag Spectrolino. This reading was used to calculate density, L*, a*, b* and c* values. The hue angle is obtained by plotting with a* on the x-axis and b* on the y-axis. The angle measured anticlockwise from the x-axis (a* axis) is defined as the hue angle. For each patch the hue angle is reported at a patch density close to 1 (1±0.1). This is shown in the table below. In addition to the hue angle, the last column also shows the change in the hue angle compared with the core toner.

| Core toner | Surface Treatment Disp | Surface Treatment Level | Hue Angle | Change in Hue Angle |
|---|---|---|---|---|
| T1 (cyan) | none | N/a | 229.90 | 0.00 |
| T1 | D1 | 1 | 229.58 | −0.32 |
| T1 | D1 | 2 | 229.71 | −0.19 |
| T1 | D1 | 4 | 229.61 | −0.29 |
| T1 | D2 | 1 | 228.31 | −1.59 |
| T1 | D2 | 2 | 227.19 | −2.71 |
| T1 | D2 | 4 | 223.02 | −6.88 |
| T1 | D3 | 1 | 232.98 | 3.07 |
| T1 | D3 | 2 | 232.30 | 2.40 |
| T1 | D3 | 4 | 233.58 | 3.68 |
| T2 (magenta) | none | N/a | 347.40 | 0.00 |
| T2 | D2 | 1 | 347.67 | 0.27 |
| T2 | D2 | 2 | 349.23 | 1.83 |
| T2 | D2 | 4 | 347.93 | 0.53 |
| T2 | D1 | 1 | 342.94 | −4.45 |
| T2 | D1 | 2 | 338.57 | −8.83 |
| T2 | D1 | 4 | 332.02 | −15.38 |
| T2 | D3 | 1 | 347.62 | 0.22 |
| T2 | D3 | 2 | 349.84 | 2.44 |
| T2 | D3 | 4 | 349.13 | 1.73 |
| T3 (yellow) | none | N/a | 96.96 | 0.00 |
| T3 | D3 | 1 | 96.62 | −0.34 |
| T3 | D3 | 2 | 96.46 | −0.50 |
| T3 | D3 | 4 | 96.04 | −0.92 |
| T3 | D1 | 1 | 106.68 | 9.72 |
| T3 | D1 | 2 | 111.90 | 14.94 |
| T3 | D1 | 4 | 119.94 | 22.98 |
| T3 | D2 | 1 | 95.61 | −1.35 |

-continued

| Core toner | Surface Treatment Disp | Surface Treatment Level | Hue Angle | Change in Hue Angle |
|---|---|---|---|---|
| T3 | D2 | 2 | 93.58 | −3.38 |
| T3 | D2 | 4 | 91.10 | −5.86 |

The hue angle made by the three colors are: close to 90 for the yellow, 240 for the cyan and close to 360 for the magenta. From the table it is seen that for each core toner the hue angle can be increased or decreased, proportionately to the level of surface treatment, by using dispersions containing the other two colors. However, when the dispersion and the core toner are of the same color, there is no significant change in hue angle.

This example illustrates that the hue (or tint) of the toner can be changed to varying degrees by using small particle dispersions containing pigments or dyes of different color than the toner. In this example the dispersions were prepared with the same pigments used in the core toners. However, it can be easily extended to use other colors or a mixture of colors in the small particle dispersions, to not only change the hue of a given toner, but to also extend the color gamut of a given toner set. The color properties of the patches were uniform as opposed to the non-uniformity one would obtain when mixtures of toners of different colors were used in a single developer.

The invention has been described in detail with particular reference to certain preferred embodiments thereof, but it will be understood that variations and modifications can be effected within the spirit and scope of the invention.

The invention claimed is:

1. A custom color toner comprising:

a base toner having a surface and having a first particle size wherein said base toner comprises a colorant and has a first color; and colored particles attached to the surface of said base toner in an amount sufficient to shift the first color by hue angle of at least 2 degrees said particles having a second particle size less than the first particle size.

2. The custom color toner of claim 1 wherein the first particle size is 2 microns or greater.

3. The custom color toner of claim 1 further comprising at least one spacing agent.

4. The custom color toner of claim 3, wherein said spacing agent comprises silica.

5. The custom color toner of claim 4, wherein the base toner comprises a polymeric binder.

6. The custom color toner of claim 1, wherein the base toner comprises a charge agent.

7. The custom color toner of claim 1, wherein the base toner comprises a wax.

8. The custom color toner of claim 1, wherein said base toner comprises cross-linked styrene acrylate or cross-linked polyester or derivatives thereof.

9. The custom color toner of claim 1 wherein said base toner is selected from the group consisting of vinyl polymers, styrene polymers, alkyl acrylates, alkyl methacrylates and styrene-acrylic copolymers.

10. The custom color toner of claim 1 wherein the colored particles particle size is less than 2 microns.

11. The custom color toner of claim 1 wherein the colored particles comprise at least 5 percent by weight of a polymeric binder.

12. The custom color toner of claim 11 wherein the polymeric binder is selected from the group consisting of vinyl polymers, styrene polymers, alkyl acrylates, alkyl methacrylates and styrene-acrylic copolymers.

13. The custom color toner of claim 1 wherein the base toner comprises a polymeric binder.

14. The custom color toner of claim 13 wherein the polymeric binder of the base toner is selected from the group consisting of vinyl polymers, styrene polymers, alkyl acrylates, alkyl methacrylates and styrene-acrylic copolymers.

15. The custom color toner of claim 1 wherein the colored particles comprise less than 20 percent by weight of the core toner.

16. The custom color toner of claim 1, wherein the base toner has particle size of 6 microns or greater; and the colored particles attached to the surface of said base toner have a particle size of less than 4 microns.

17. A developer comprising:

a custom color toner according to claim 1; and magnetic carrier particles.

* * * * *